US007281534B2

(12) United States Patent
Bednar

(10) Patent No.: US 7,281,534 B2
(45) Date of Patent: Oct. 16, 2007

(54) CROSSBOW WITH STOCK SAFETY MECHANISM

(75) Inventor: William Bednar, Suffield, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 11/037,585

(22) Filed: Jan. 18, 2005

(65) Prior Publication Data

US 2005/0217651 A1 Oct. 6, 2005

Related U.S. Application Data

(60) Provisional application No. 60/537,129, filed on Jan. 17, 2004.

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS

| | | | | |
|---|---|---|---|---|
| 934,065 | A | | 9/1909 | Gates |
| 1,098,048 | A | | 5/1914 | Neary |
| 1,204,426 | A | | 11/1916 | Gladwin et al. |
| 1,335,988 | A | | 4/1920 | Schmidt |
| 1,379,238 | A | | 5/1921 | Barnard |
| 2,273,204 | A | | 2/1942 | Kneubuehl |
| 2,380,140 | A | | 7/1945 | Anderson |
| 2,457,929 | A | | 1/1949 | Slockbower |
| 2,484,928 | A | | 10/1949 | Boone |
| 2,525,886 | A | | 10/1950 | Fraser |
| 2,775,051 | A | | 12/1956 | Gehman |
| 2,819,550 | A | | 1/1958 | Fischer |
| 2,979,845 | A | | 4/1961 | Christiansen, Jr. |
| 3,125,998 | A | * | 3/1964 | Stevens ..... 124/25 |
| 3,222,809 | A | | 12/1965 | Bryan |
| 3,724,114 | A | | 4/1973 | Jones et al. |
| 4,010,566 | A | | 3/1977 | Edwards |
| 4,070,783 | A | | 1/1978 | Edwards |
| 4,141,166 | A | | 2/1979 | Schultz |
| 4,192,281 | A | | 3/1980 | King |
| 4,294,222 | A | * | 10/1981 | Pelsue ..... 124/25 |
| 4,302,898 | A | | 12/1981 | LaRue |
| 4,392,319 | A | | 7/1983 | Ottolini |
| 4,414,769 | A | | 11/1983 | Mueschke |
| 4,590,697 | A | | 5/1986 | Ruger et al. |
| 4,721,092 | A | | 1/1988 | Waiser |
| 4,726,136 | A | | 2/1988 | Dornaus et al. |
| 4,730,406 | A | | 3/1988 | Forbes et al. |
| 4,834,059 | A | | 5/1989 | Moorhouse et al. |
| 4,841,656 | A | | 6/1989 | Brandt |
| 4,887,583 | A | | 12/1989 | Lin |
| 4,926,574 | A | | 5/1990 | Rieger |
| 5,010,676 | A | | 4/1991 | Kennedy |
| 5,025,771 | A | * | 6/1991 | Hanson ..... 124/25 |
| 5,090,147 | A | | 2/1992 | Pastor |

(Continued)

*Primary Examiner*—John A. Ricci
(74) *Attorney, Agent, or Firm*—Brouse McDowell; John M. Skeriotis

(57) ABSTRACT

A crossbow includes a safety mechanism located on the stock of the crossbow that prevents the crossbow from firing until the safety mechanism is properly engaged. The safety mechanism includes a push button that requires the operator appendages to be securely below the path of the traveling bolt before the trigger mechanism will release.

5 Claims, 4 Drawing Sheets

U.S. PATENT DOCUMENTS 5,212,327 A 5/1993 Schuemann
5,215,069 A 6/1993 Liu
5,247,922 A 9/1993 Lalonde
5,508,683 A 4/1996 Hall
5,560,134 A 10/1996 Van Niekerk et al.
5,619,979 A * 4/1997 Ossege ..... 124/25
5,649,520 A * 7/1997 Bednar ..... 124/25
5,678,528 A 10/1997 Hadley
5,884,614 A * 3/1999 Darlington et al. ..... 124/25
5,915,936 A 6/1999 Brentzel
5,937,557 A 8/1999 Bowker et al.
6,073,380 A 6/2000 Hauser et al.
6,205,990 B1 * 3/2001 Adkins ..... 124/25
6,282,829 B1 9/2001 Mossberg et al.
6,286,240 B1 9/2001 Collins
6,412,207 B1 7/2002 Crye et al.

* cited by examiner

CROSSBOW WITH STOCK SAFETY MECHANISM

The U.S. Utility patent application claims priority to U.S. provisional patent Ser. No. 60/537,126 filed on Jan. 17, 2004.

I. BACKGROUND OF THE INVENTION

A. Field of Invention

This invention pertains to the art of methods and apparatuses for safely discharging a crossbow device, and more specifically to a safety device that maintains the fingers of the operator in a safe position during discharge of the crossbow device.

B. Description of the Related Art

It is known in the art to draw back the bowstring for a crossbow device. Since crossbows propel the bolts there from with the force of the bowstring, a substantial bowstring force is needed to accurately target the intended game. As a result, during discharge of the crossbow the force is exerted on the projectile through the bowstring.

It is also known that during discharge of the cross bow and bowstring respectively certain associated operator's have placed a thumb or finger in the path of the moving bowstring, causing injury to the associated operator's appendage. What is needed is a device that maintains the appendages of the associated operator's hand that grasps the stock of the crossbow in a safe location during discharge of the crossbow and bowstring.

II. SUMMARY OF THE INVENTION

One aspect of the present invention includes, a crossbow, comprising: a crossbow stock; a crossbar having first and second ends and a center portion, the crossbar being fixedly connected to the stock at the center portion; a crossbow string operatively connected between the first and second ends of the crossbar for use in projecting an associated projectile; a trigger mechanism having a crossbow string latch, the trigger mechanism being operatively connected to the stock; and, a stock safety mounted at least partially on the crossbow stock for use in preventing activation of the trigger mechanism.

Another aspect of the present invention includes a second selectively engageable trigger safety for use in preventing activation of the trigger mechanism.

Yet another aspect of the present invention includes, stock safety biasing means for use in biasing the stock safety into a default safety position.

Still another aspect of the present invention includes the stock safety being operatively received inside the crossbow stock, the stock safety having a mechanical linkage, the stock safety having at least a first push button operatively connected to the mechanical linkage; and, wherein the mechanical linkage is selectively moveably connected to inhibit movement of the trigger mechanism responsive to the position of the at least a first push button.

Yet another aspect of the present invention includes at least a first push button is positioned on a first side of the crossbow stock; and, further comprises: a second push button positioned on a second side of the crossbow stock for use in preventing activation of the trigger mechanism.

Still yet another aspect of the present invention includes the stock safety comprising at least a first push button; a rod member fixedly connected with respect to the at least a first push button; a spring operatively connected to bias the rod member and the at least a first push button into a default position; and, at least a first linkage member pivotally connected with respect to the crossbow stock, the at least a first linkage member fixedly connected to the rod member at a first end, the at least a first linkage member having a bifurcated portion for use in selectively engaging the trigger mechanism.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
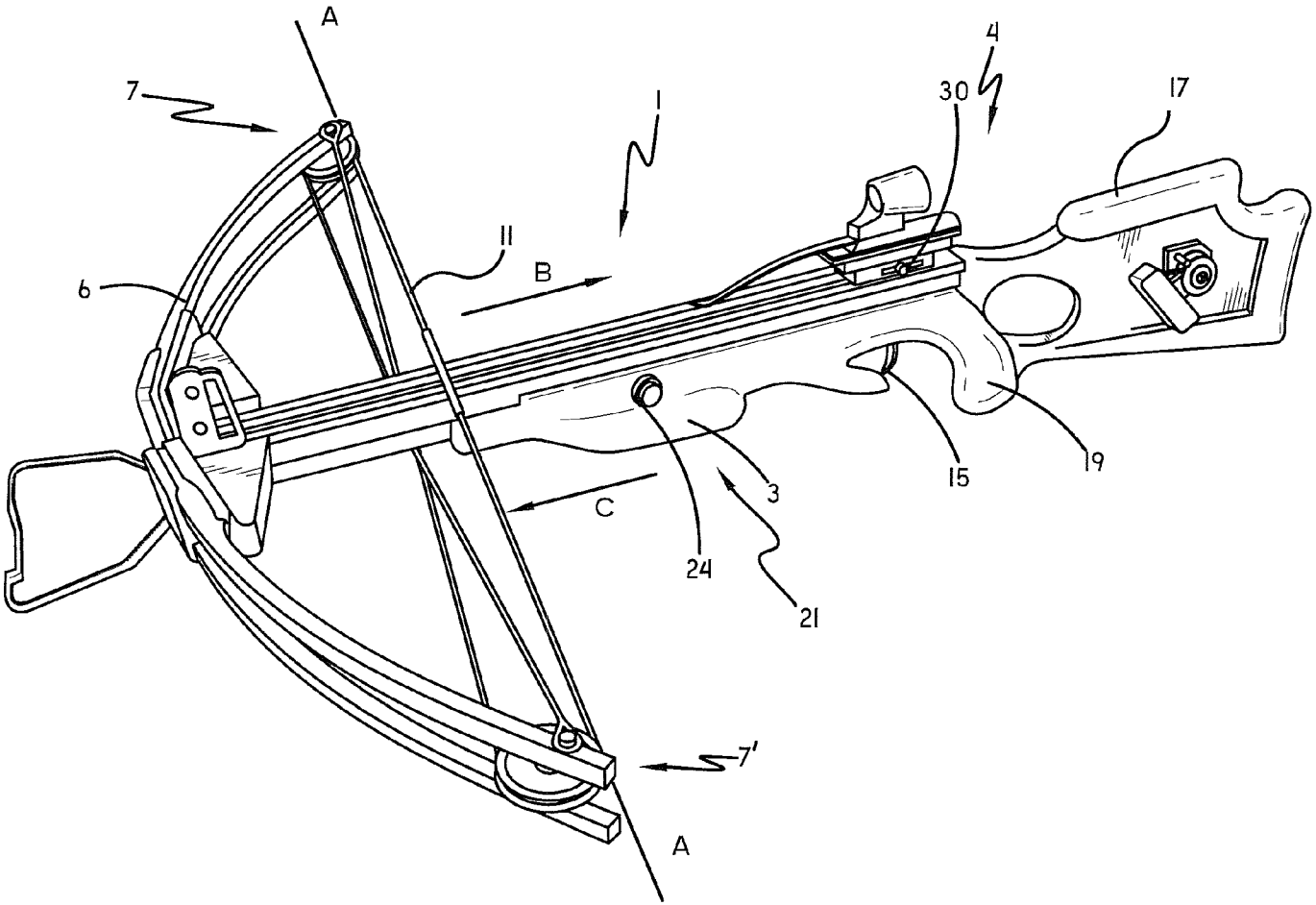
FIG. 1 is a picture of the crossbow showing the stock safety device.

Referring now to the drawings wherein the showings are for purposes of illustrating a preferred embodiment of the invention only and not for purposes of limiting the same, FIG. 1 shows a crossbow depicted generally at 1. The crossbow 1 may include a crossbow stock 3. The stock 3 may be generally longitudinal having first and second ends 4, 4' respectively. A crossbar 6 may be juxtaposed to the first end 4 of the stock 3 and fixedly connected thereto in a manner well known in the art. The crossbar 6 may include first and second ends 7, 7' that define an axis A that extends generally perpendicular to the longitudinal axis of the stock 3. The ends 7, 7' of the crossbar 6 may receive a bowstring 11 that extends between the ends 7, 7' of the crossbar 6 in a manner well known in the art. The crossbow 1 may be configured such that when the bowstring 11 is drawn back in a first direction B, the crossbar 6 may flex or bend storing potential energy in the device 1. The bowstring 11 may be secured in place by a trigger mechanism 15 having a crossbow string latch, not shown, that selectively holds the bowstring 11 until it is desired to release or discharge the crossbow 1. When an associated operator draws the crossbow string back the string 11 is received by the latch, not shown, and is held in place until the trigger mechanism 15 is released. Once the crossbow string 11 has been drawn back, an associated operator may place a projectile or bolt, not shown, onto the top portion of the stock 3 and fit a first end of the bolt over the bowstring 11. After such time, the trigger mechanism 15 may be engaged; releasing the force stored in the device 1 and propelling the projectile forward in a direction C.

Figure 2:
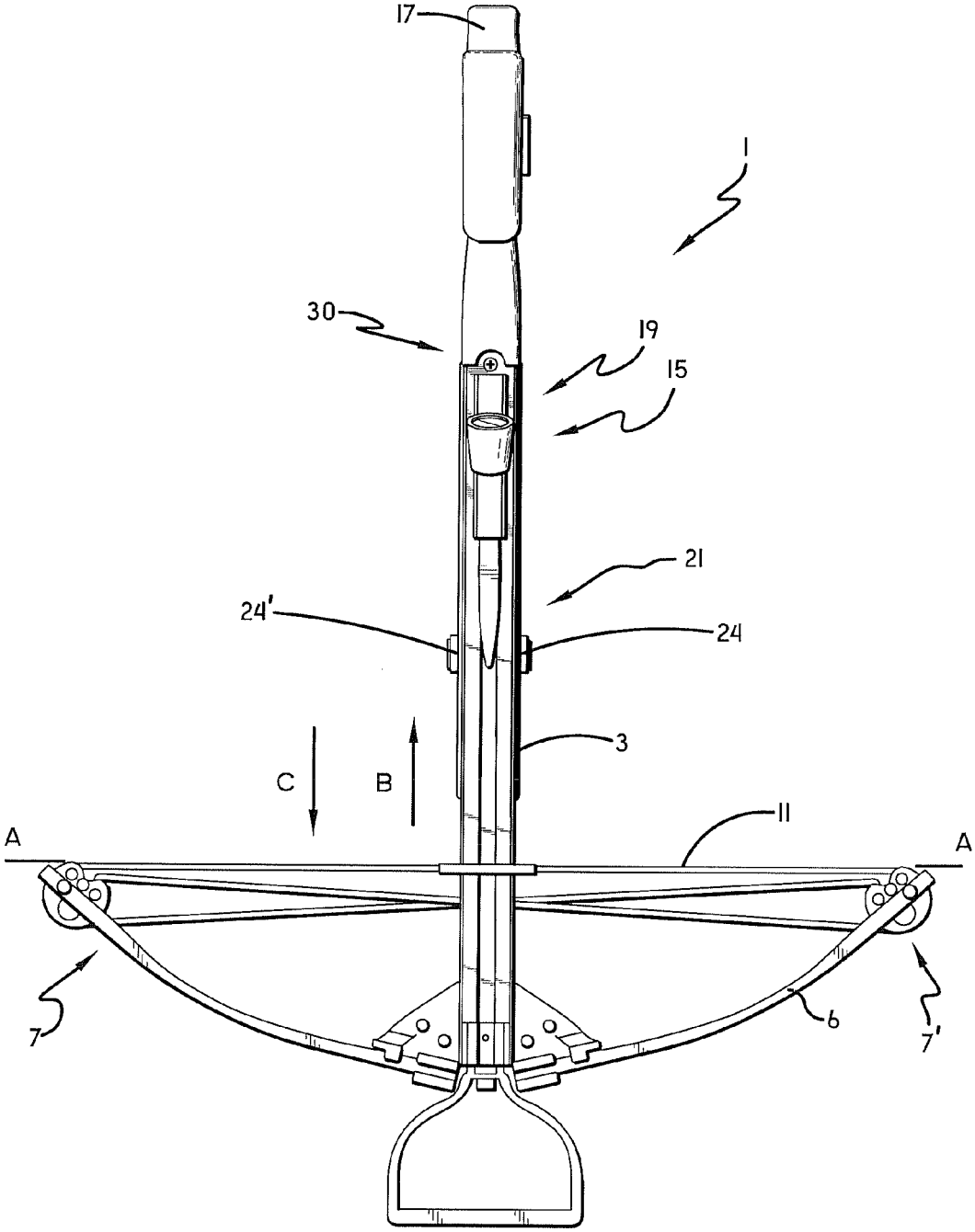
FIG. 2 is a picture of the crossbow showing the stock safety device.

With reference now to FIGS. 1 and 2, the crossbow 1 may include a crossbow butt 17. The butt 17 of the crossbow 1 may be juxtaposed to the associated operator' shoulder during discharge of the device 1. A grip 19 may be fashioned in the stock 3 wherein the trigger mechanism 15 is installed proximate to the grip 19; toward the second end 4' of the stock 3. This allows the associated operator to securely grasp the crossbow 1 with a first hand during operation of the device 1. The other hand of the associated operator may grasp the stock 3 toward the first end 4 thereof. This allows the operator to firmly hold the crossbow 1 during operation and discharge.

Figure 3:
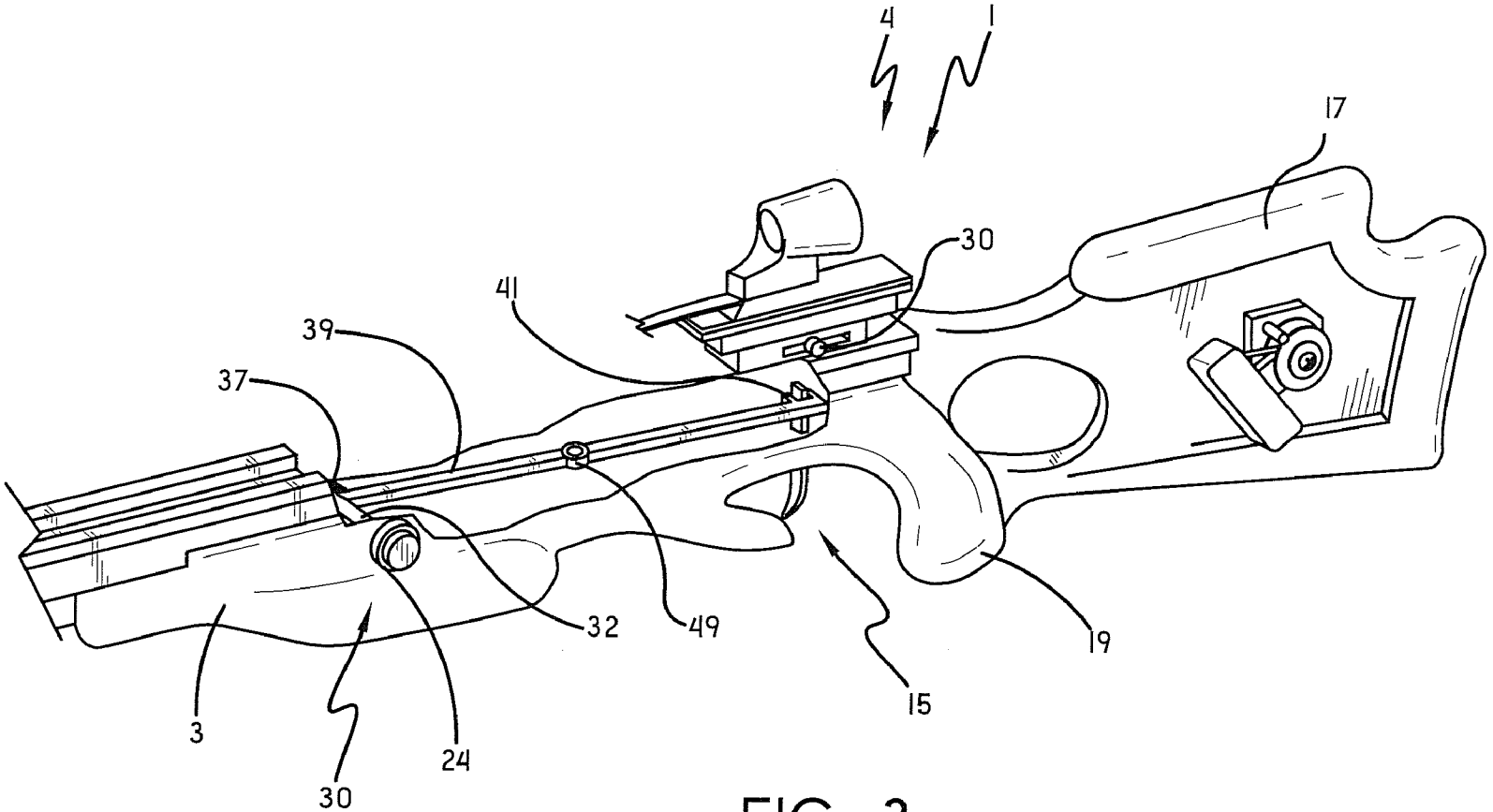
FIG. 3 is a picture of the crossbow showing the stock safety device.

With reference again to FIGS. 1 and 2 and now to FIG. 3, the crossbow 1 may include a safety 30 for use in preventing the trigger mechanism 15 from engaging and thus from preventing discharge of the crossbow 1 when the bowstring 11 is drawn back. The safety 30 may be a mechanical safety interconnected to the trigger mechanism 15 such that when the safety 30 is engaged the trigger mechanism 11 cannot be operated, which prevents the crossbow 1 from being fired as previously discussed. In other words, when the safety 30 is engaged the trigger mechanism 15 cannot be pulled back or fired. The safety 30 may be configured in any manner chosen with sound engineering judgment. In one embodiment, the safety 30, when engaged, prevents the trigger mechanism 15 from firing by placing a mechanical block into the path of the trigger mechanism 15 thereby preventing the trigger mechanism 15 from moving and thereby preventing the crossbow 1 from firing.

With reference to FIGS. 1 through 3, the crossbow 1 may also include a safety mechanism 21 for preventing the crossbow from firing when the operator appendages are in the path of the traveling projectile. In one embodiment, the safety mechanism 21 may be a stock safety mechanism or stock safety 21. The stock safety 21 may include a first push button 24 mounted proximate to the position where the associated operator would grasp the stock 3 of the crossbow 1 during operation. In this manner, the crossbow 1 may only be fired when the stock safety button 24 is depressed. Since depressing the button 24 requires the use of the operator's thumb, and/or fingers on the opposing side of the stock, to apply pressure to the button 24, the crossbow may only be fired when the thumb and/or finger is in contact with the button 24. In that the button 24 is disposed on the stock 3 and below the path of travel of the bowstring, the bowstring cannot cause injury to the thumb and/or fingers thus providing a safety mechanism that prevents injury to the hand grasping the stock of the crossbow 1. It is noted here that a firm grip on the stock 3 of the crossbow 1 is needed to properly fire the crossbow. Thus, the safety mechanism 21 would allow the operator to properly grasp the stock 3 while engaging the safety mechanism 21. The position of the stock safety 21 may reside on the either side of the stock depending on the handedness of the associated operator. In other words, the stock safety 21 may be configured for either a left-handed or a right-handed operator. In an alternate embodiment, the stock safety 21 may include first 24 and second 24' buttons, wherein the buttons 24, 24' reside one on each side of the stock 3 respectively. In this manner, the stock safety 21 may require the operator to depress the first button 24 with the operator's thumb, for example and to depress the second button 24' with the operator's fingers simultaneously to disengage the stock safety 21 for discharging the crossbow 1. It is noted that the stock safety 21 is normally engaged or biased in a default position to prevent firing of the crossbow. That is to say that when the crossbow 1 is set down after use, the safety mechanism 21 is biased to automatically engage thus preventing the trigger mechanism from moving. It is also noted here that the safety mechanism 21 works in conjunction with the safety 30. Both safeties must be disengaged for the crossbow 1 to be fired.

Figure 4:
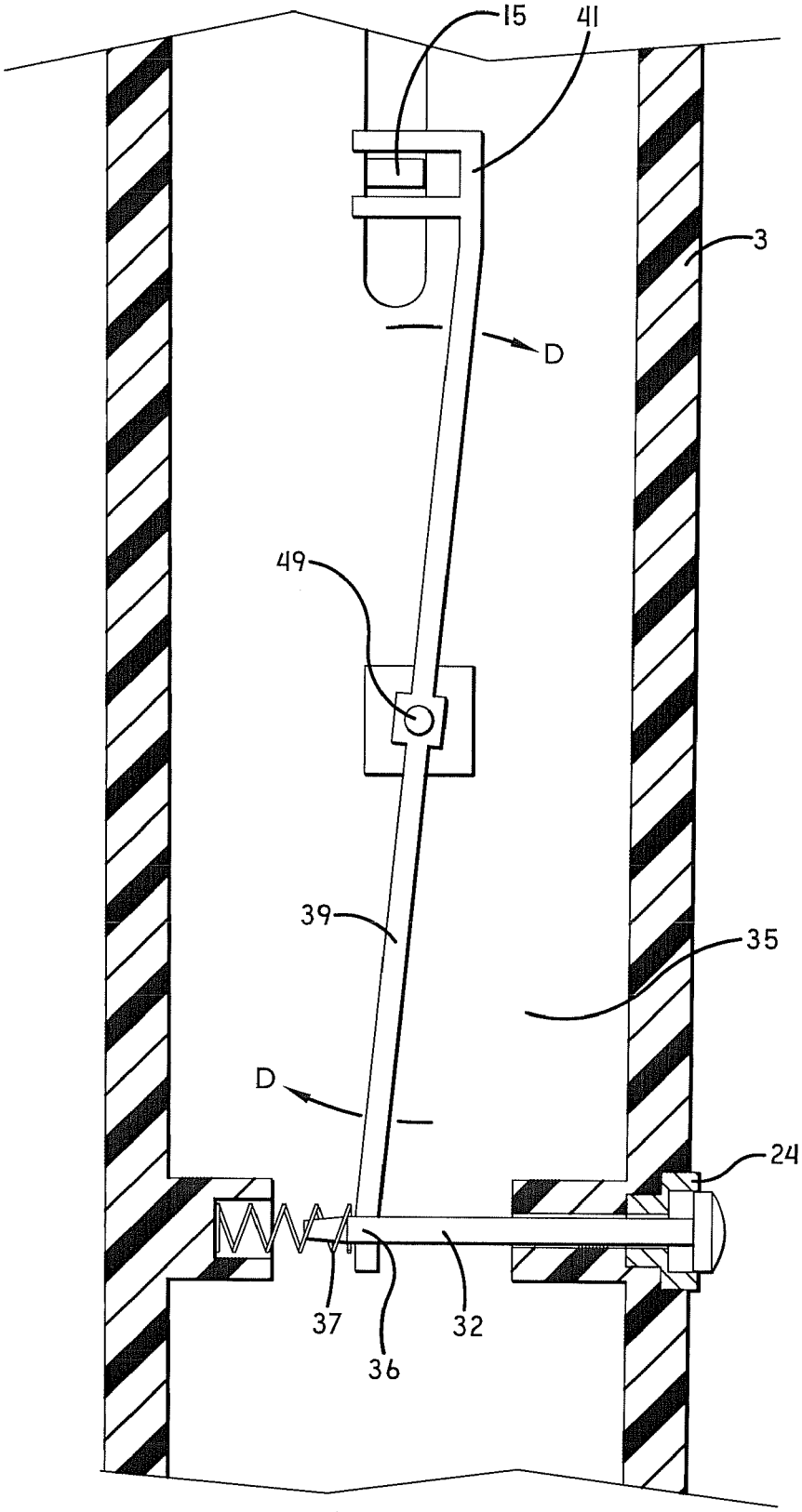
FIG. 4 is a partial cutaway top view of the stock of the crossbow showing the stock safety device.

With continued reference to FIGS. 1 through 3 and now to FIG. 4, the push button 24 may be disposed within the stock 3 of the crossbow 1 and extended to the exterior of the stock 3 for access by the operator. On the inside of the stock 3, the push button 24 may be connected to a rod member 32. The first end 36 of the rod member 32 may contact biasing means 37, which may be a spring 37, for use in biasing the push button 24 into a default position. Any type of biasing means may be chosen with sound engineering judgment as is appropriate for use with the present invention. In this manner, when the operator releases the push button 24, the rod member 37 and the push button 24 return to a default safety state as biased by the spring 37. A rigid linkage member 39 may also be included that is fixedly connected to the rod member 32 at a first end of the linkage member 39. The distal end of the rigid linkage member 39 may include a bifurcated portion 41 that may engage the trigger mechanism 15. The bifurcated portion 41 may be integrally formed with linkage member 39. However, any configuration of linkage member 39 and bifurcated portion 41 may be chosen with sound engineering judgment. Accordingly, the entire linkage member 39 may be pivotally connected with respect to the body of the stock 3, thereby allowing the linkage member 39 and the bifurcated portion 41 to pivot into and out of engagement with the trigger mechanism 15, as shown in FIG. 4. It is noted here that the linkage member 39 may pivot about a fixed point 49 within the stock 3 but may not move otherwise. Any manner of allowing the linkage member 39 to pivot without otherwise translating may be chosen with sound engineering judgment. When the operator depresses the push button 24, thus overcoming the force of the biasing means 37, the rod member 32 may pivot the linkage member 39 and more specifically the bifurcated end 41 of the linkage member 39 out of engagement with the trigger 15. Therefore, the stock safety 21 is normally engaged, and must be intentionally disengaged in order to pull the trigger mechanism 15 thus firing the crossbow 1. It should be emphasized that the present embodiment discusses a mechanical safety mechanism 21 including a mechanical linkage member 39. However, it is noted that any assembly and/or configuration of linkage members, including but not limited to mechanical, electrical, electromagnetic, and the like may be chosen with sound engineering judgment.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A crossbow, comprising:

a crossbow stock;

a crossbar having first and second ends and a center portion, the crossbar being fixedly connected to the stock at the center portion;

a crossbow string operatively connected between the first and second ends of the crossbar for use in projecting an associated projectile;

a trigger mechanism having a crossbow string latch, the trigger mechanism being operatively connected to the stock;

a stock safety mounted at least partially on the crossbow stock for use in preventing activation of the trigger mechanism;

at least a first push button;

a rod member fixedly connected with respect to the at least a first push button;

a spring operatively connected to bias the rod member and the at least a first push button into a default position; and, at least a first linkage member pivotally connected with respect to the crossbow stock, the at least a first linkage member fixedly connected to the rod member at a first end, the at least a first linkage member having a bifurcated portion for use in selectively engaging the trigger mechanism.

2. The crossbow of claim 1, further comprising:

a second selectively engageable trigger safety for use in preventing activation of the trigger mechanism.

3. The crossbow of claim 1, further comprising:

stock safety biasing means for use in biasing the stock safety into a default safety position.

4. The crossbow of claim 1, wherein the stock safety is operatively received inside the crossbow stock, the stock safety having a mechanical linkage, the stock safety having at least a first push button operatively connected to the mechanical linkage; and, wherein the mechanical linkage is selectively moveably connected to inhibit movement of the trigger mechanism responsive to the position of the at least a first push button.

5. The crossbow of claim 1, wherein the at least a first push button is positioned on a first side of the crossbow stock; and, further comprising:

a second push button positioned on a second side of the crossbow stock for use in preventing activation of the trigger mechanism.

* * * * *